US006772816B2

(12) United States Patent
Carter et al.

(10) Patent No.: US 6,772,816 B2
(45) Date of Patent: Aug. 10, 2004

(54) PORTABLE DISPLAY CASE

(75) Inventors: Wallace T. Carter, 1918 Verrazzano Dr., Wilmington, NC (US) 28405; Paul Bradley Forrest, Cary, NC (US); Robert Grant McRorie, III, Raleigh, NC (US)

(73) Assignee: Wallace T. Carter, Wilmington, NC (US)

( * ) Notice: Subject to any disclaimer, the term of this patent is extended or adjusted under 35 U.S.C. 154(b) by 74 days.

(21) Appl. No.: 10/108,442

(22) Filed: Mar. 29, 2002

(65) Prior Publication Data

US 2003/0183348 A1 Oct. 2, 2003

(51) Int. Cl.[7] ..... A47G 5/00
(52) U.S. Cl. ..... 160/135
(58) Field of Search ..... 160/135, 351, 160/352; 40/605, 606, 610; 52/239, 238.1

(56) References Cited

U.S. PATENT DOCUMENTS

| | | | | |
|---|---|---|---|---|
| 2,549,306 A | | 4/1951 | Greene | |
| 2,707,538 A | | 5/1955 | Mayer, Sr. et al. | |
| 3,297,118 A | | 1/1967 | Skyhawk et al. | |
| 3,565,152 A | * | 2/1971 | Cohn et al. | 160/135 |
| 3,938,772 A | | 2/1976 | Andrusiak | |
| 4,147,198 A | | 4/1979 | Ytter | |
| 4,200,254 A | * | 4/1980 | Nelson | 160/351 X |
| 4,524,852 A | | 6/1985 | Hess | |
| 4,678,018 A | | 7/1987 | Grundstedt et al. | |
| 4,785,565 A | | 11/1988 | Kuffner | |
| 4,833,802 A | | 5/1989 | Volkert | |
| 4,852,498 A | | 8/1989 | Judd | |
| 4,893,711 A | | 1/1990 | Gustafson | |
| 5,220,952 A | | 6/1993 | Beauleu | |
| 5,439,043 A | | 8/1995 | Carter | |
| 5,651,405 A | * | 7/1997 | Boeddeker et al. | 160/135 |
| 5,791,391 A | | 8/1998 | Carter | |
| 5,875,591 A | * | 3/1999 | Jines | 160/351 X |
| 6,189,594 B1 | * | 2/2001 | Carter | 160/135 |

* cited by examiner

*Primary Examiner*—David Purol
(74) *Attorney, Agent, or Firm*—Diller, Ramik & Wight

(57) ABSTRACT

A portable display case includes four panels with adjacent panels being connected by pivots defining substantially parallel axes. The panels are pivotable between a closed position in which the panels are in face-to-face contiguous opposing relationship and an open position. Two center panels include handle members pivotally connected thereto at upper edges and wheelable members connected thereto at lower edges. The handle members and the wheelable members include recesses and projections for registering with projections and recesses, respectively, of adjacent outermost panel members. The recess and projections facilitate the stacking of identical portable displays atop each other. The handle members and the base members pivot through 180° for respectively latching and unlatching the panel members in their respective closed and open positions.

118 Claims, 9 Drawing Sheets

PORTABLE DISPLAY CASE

BACKGROUND OF THE INVENTION

This invention is directed to a display system which is portable, free-standing, and can be packed, unpacked and/or prepacked, transported and utilized readily for display purposes at sales presentations, conventions, seminars or the like.

The display system is preferably a portable, self-contained folding panel system having compartments for housing accessories, such as halogen lights, a header, literature, graphics, power cords, sales literature and the like. The portable display, display system or portable display case includes a number of display panels which are connected by pivots to effect rapid opening and closing of the portable display case between a closed position in which the panels or panel members are in face-to-face contiguous relationship and an open position in which the panel members are substantially in open, upright, self-supporting position.

A portable display case of the latter type is disclosed in U.S. Pat. No. 6,189,594 B1 granted to Wallace T. Carter on Feb. 20, 2001. The patented portable display case includes four panels which are connected together along three substantially parallel pivot axes which promote the open-to-closed and closed-to-open movement just described. The latter portable display case is self-supporting its open position, can be latched in its closed position, includes compartments for various items, and has an extendable and contractible handle in furtherance of portability. The totality of the latter patent with respect to conventional details is incorporated herein by reference.

Other examples of conventional display systems include those listed in U.S. Pat. No. 6,189,594 B1, namely:

| | |
|---|---|
| 2,549,306 | Greene |
| 2,707,538 | Mayer, Sr. et al. |
| 3,297,118 | Skyhawk et al. |
| 3,938,772 | Andrusiak |
| 4,147,198 | Ytter |
| 4,524,852 | Hess |
| 4,678,018 | Grundstedt et al. |
| 4,785,565 | Kuffner |
| 4,833,802 | Volkert |
| 4,852,498 | Judd |
| 4,893,711 | Gstafson |
| 5,220,952 | Beaulieu |
| 5,439,043 | Carter |
| 5,791,391 | Carter |

SUMMARY OF THE INVENTION

A novel portable display of the present invention includes a portable display case formed of a plurality of panel members with adjacent panel members being pivotally connected to each other. The portable display case preferably includes four such panel members with each panel member having upper, lower and side edges or edge portions with adjacent side edge portions being pivotally connected to each other for movement between a closed position in which panel faces of the panel members are in substantially face-to-face opposing relationship in substantially parallel planes and an open display position in which the panel members are in substantially side-by-side upright relationship. In addition to the latter structure, the portable display case of the invention includes one or more of the following structural features:

1. At least one of the panel members has pivoted thereto along its upper edge a handle member which can be gripped by a user when carrying or pulling the portable display case along a supporting surface. Preferably, there are two such handle members, carried one each by adjacent panel members, with each handle member including a hand opening and a hand grip which in the closed position of the portable display case collectively define an opening which can be spanned by a person's hand and a hand grip which can be gripped thereby.
2. A base member is pivotally connected to at least one of the panel members and preferably to two panel members along lower or bottom edges thereof. In one position, the base members serve as support feet or stabilizing feet for the portable display case in its open position and in the closed position of the portable display case one of the base members includes at least one wheel which facilitates the wheeling of the portable display case along a supporting surface.
3. The handle members and the base members each include projections and recesses which register with projections and recesses of adjacent outermost panels in the closed position of the portable display case and register with projections and recesses of an identically constructed portable display case when two such portable display cases are stacked one upon the other.
4. Each handle member includes a downwardly projecting tongue which overlies an exterior surface of an outermost panel member in the closed position of the portable display case, and each base member includes a latch for cooperatively latching with a lower edge of an associated outermost panel member in the closed position of the portable display case. The tongue and latching mechanisms prevent each of two innermost and outermost panel members from being inadvertently unfolded.
5. Additional cooperatively latch members secure edges of two of the center-most panels in the closed position of the portable display case which, in conjunction with the aforesaid tongue and latching mechanisms, assures that the portable display case remains locked in its closed position.
6. Two of the portable display cases have identical but mirror images of pairs of adjacent projections and recesses can be aligned thereby in vertically stacked relationship.

With the above and other objects in view that will hereinafter appear, the nature of the invention will be more clearly understood by reference to the following detailed description, the appended claims and the several views illustrated in the accompanying drawings.

DETAILED DESCRIPTION OF THE INVENTION

Figure 1:
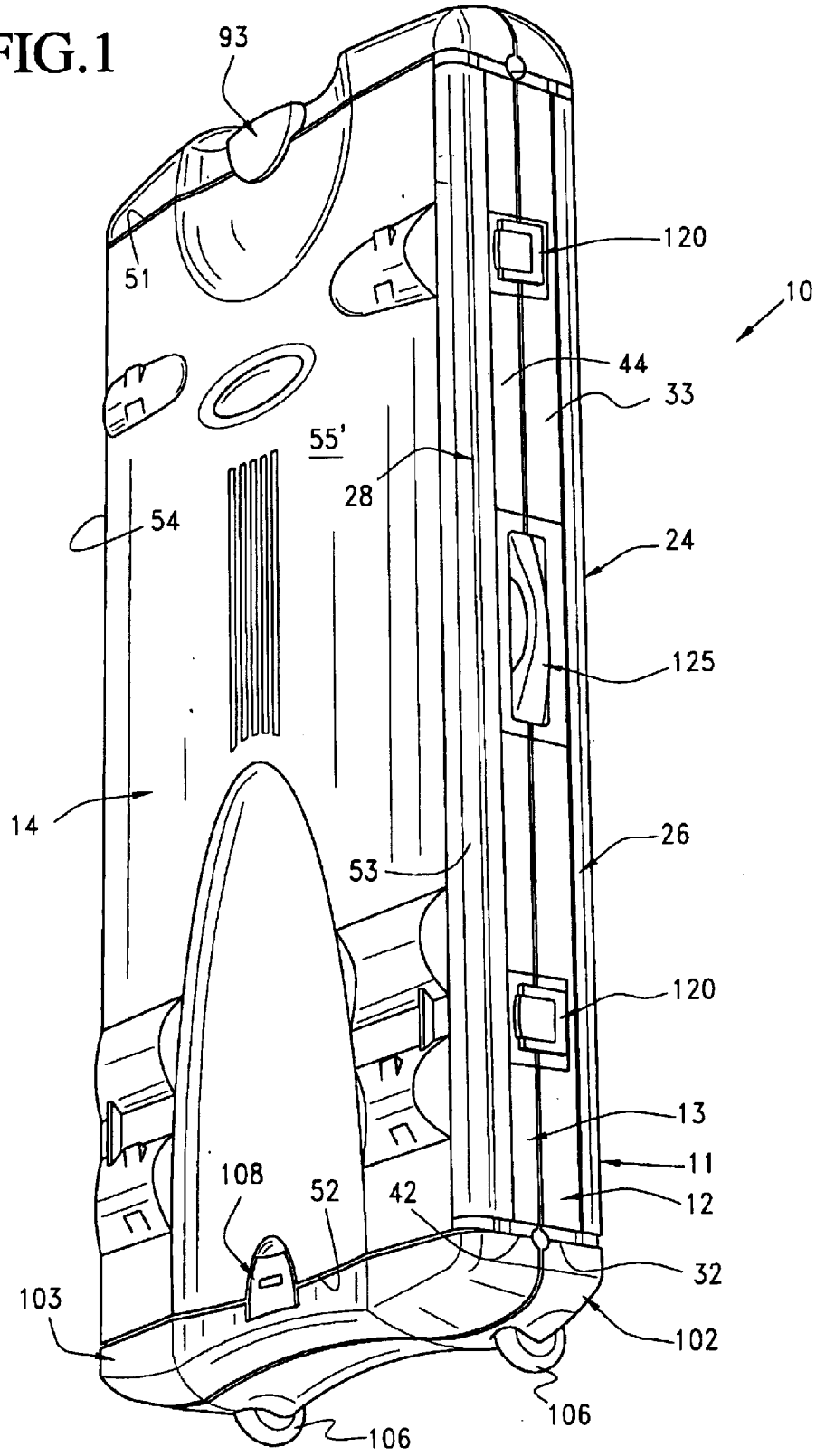
FIG. 1 is a rear perspective view of a novel portable display or display case constructed in accordance with the invention, and illustrates four panel members, two handle members and two base members in the closed position of the portable display case.

A novel portable display or portable display case constructed in accordance with this invention is generally designated by the reference numeral 10 and includes a plurality of panel members 11 through 14 which are illustrated in a closed, carrying, rolling, wheeling or transporting position (FIG. 1) and an open or display position (FIGS. 2 through 4 and 10).

Each of the panel members 11 through 14 are blow-molded double-wall reinforced polyethylene or similar polymeric/copolymeric synthetic plastic material which lessens the weight of the overall portable display case 10 while at the same time increasing the rigidity thereof.

Figure 2:
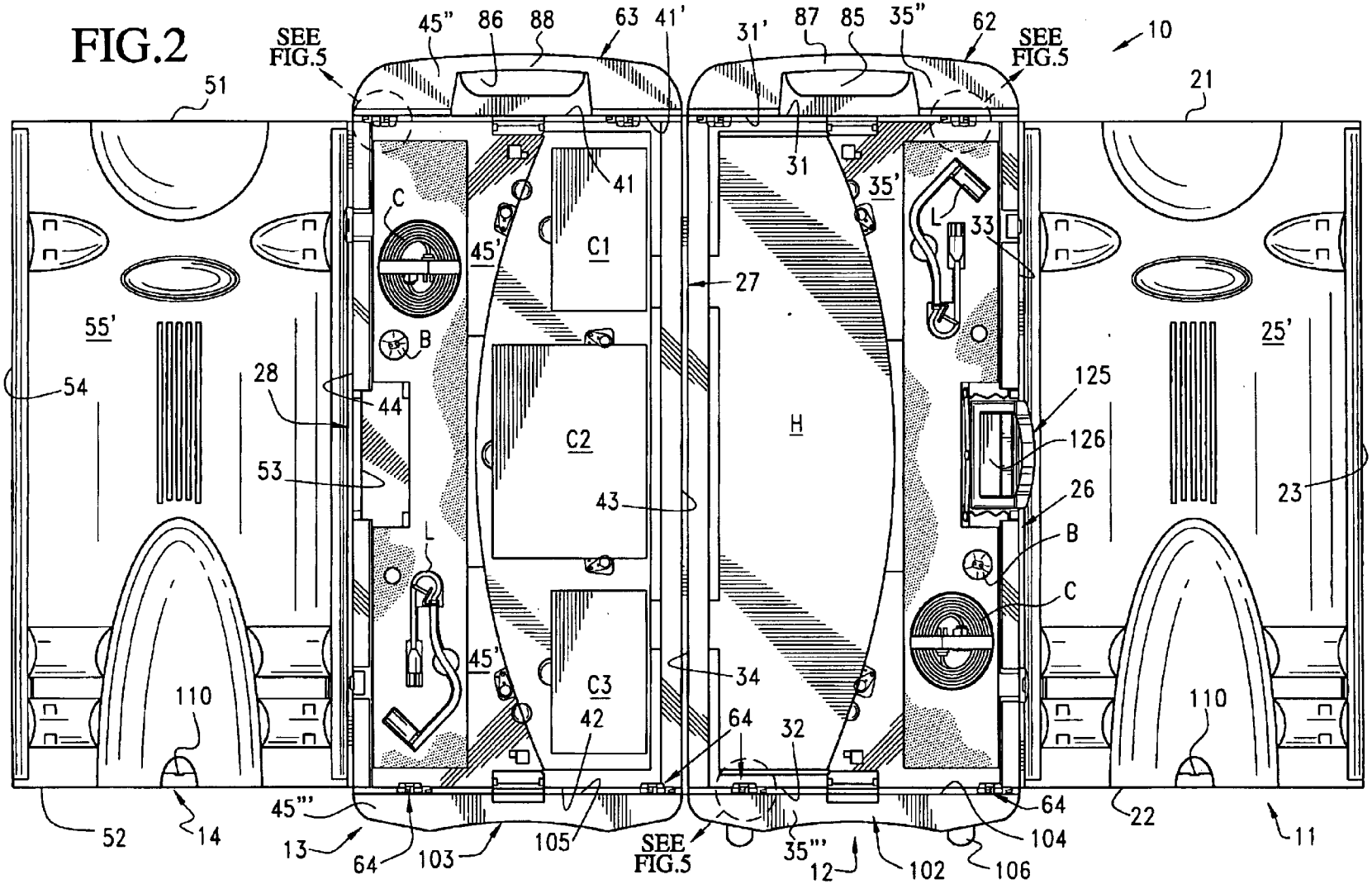
FIG. 2 is a rear view of the portable display case in its open position, and illustrates each of two handle members and base members in the plane of their respective panel members and items such as a header, a light socket, etc., housed in appropriate receptacles of a center-most two of the panel members.
Figure 3:
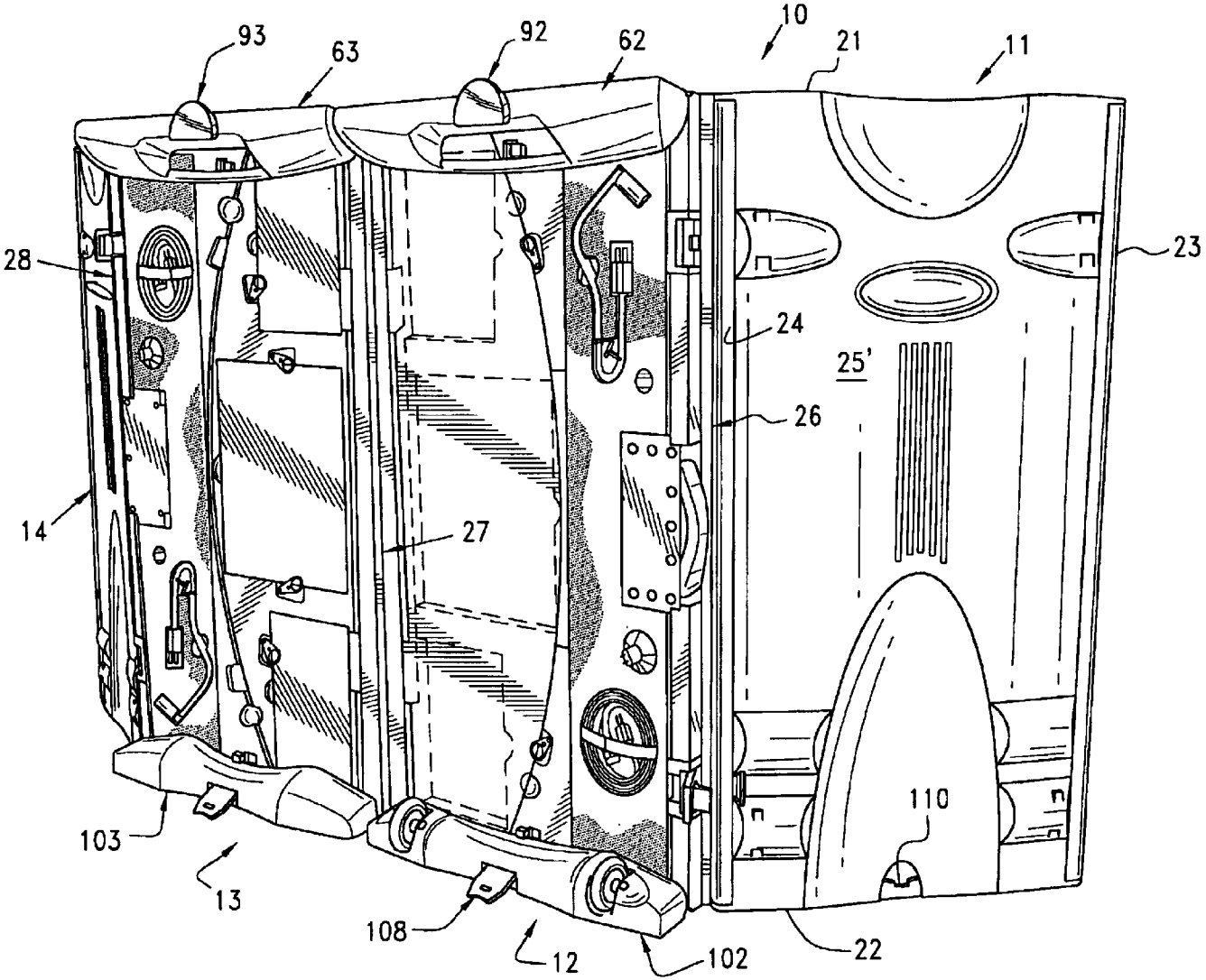
FIG. 3 is a fragmentary rear perspective view of the portable display case similar to FIG. 2, and illustrates the two handle members and the two base members rotated through an arc of 180° from the positions illustrated in FIG. 2 whereupon the base members form stabilizing bases or feet to effectively support the portable display case in its upright open display position.
Figure 4:
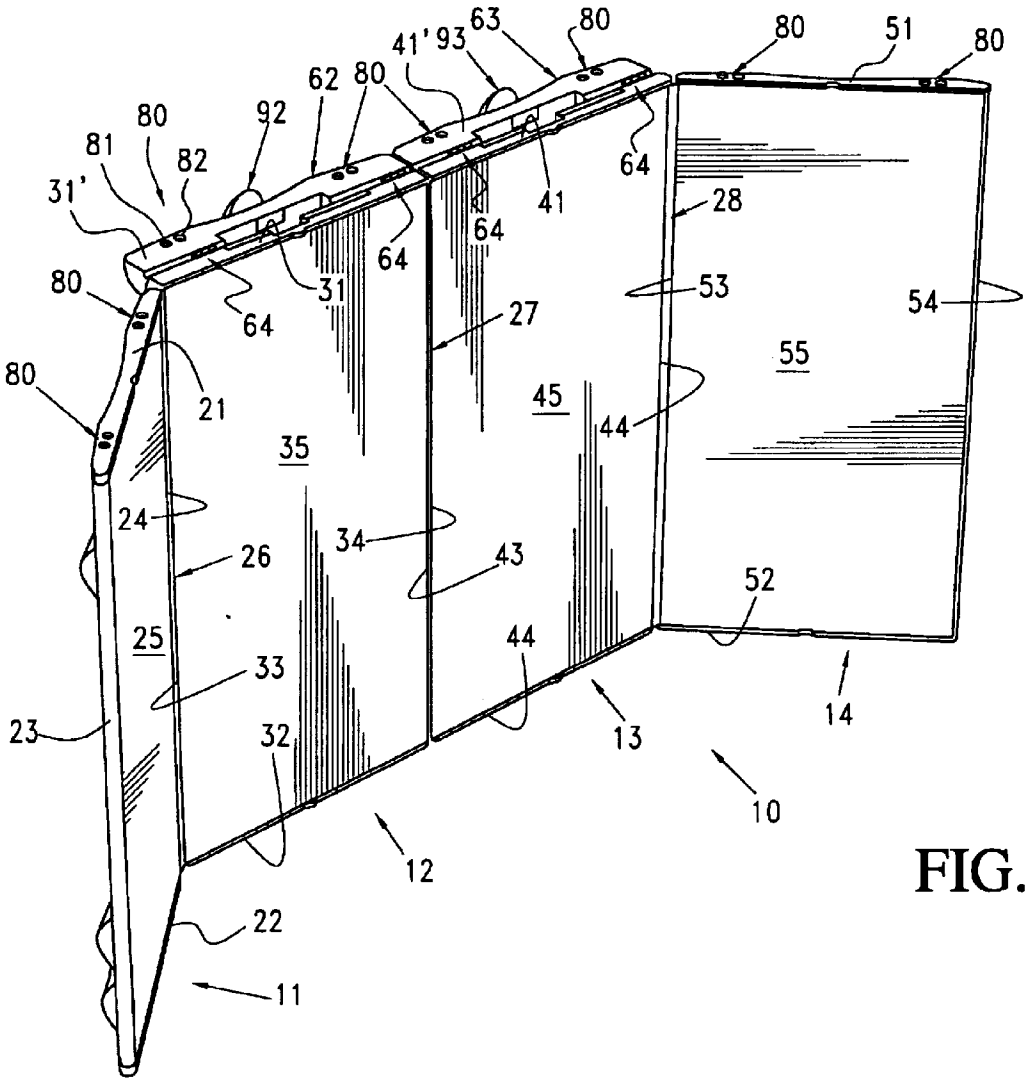
FIG. 4 is a front perspective view of the portable display case in its open upright display position, and illustrates front faces or surfaces upon which graphics can be displayed.

The panel member 11 is an outermost, outer or exterior panel member and includes an upper edge or edge portion 21, a lower edge or edge portion 22 substantially parallel to the upper edge portion 21, and opposite generally parallel side edges or side edge portions 23, 24 (FIGS. 2 through 4).

The panel member 12 likewise includes an upper edge or edge portion 31 substantially parallel to a lower edge or edge portion 32 and opposite substantially parallel side edges or side edge portions 33, 34.

The panel member 13 includes an upper edge or edge portion 41, a lower edge or edge portion 42 substantially parallel thereto, and opposite generally parallel side edges or side edge portions 43, 44.

The panel member 14 is an outermost, outer or exterior panel member that includes upper and lower edges or edge portions 51, 52 disposed substantially parallel to each other, and opposite substantially parallel vertical side edges or side edge portions 53, 54.

The front or "display" surfaces (not shown) of each of the panel members 11 through 14 are covered by a sheet of aesthetic fabric material or the like to define respective display panels 25, 35, 45 and 55 (FIG. 4). Adjacent vertical edge portions 24, 33 (FIGS. 2 and 4) of the adjacent panel members 11, 12, respectively, are pivotally connected together by pivot means 26 in the form of a so-called "living" hinge formed of flexible polymeric/copolymeric material which extends the length of and is fastened to each of the edges 24, 33 of the respective panel members 11, 12. Substantially identical "living" hinges or pivot means 27, 28 pivotally connect together the panels 12, 13 and 13, 14, respectively. The pivot means 26, 27 and 28 are in substantially parallel relationship to each other, and each defines a generally vertical pivot axis (unnumbered) in the open position of the portable display case 10.

Figure 10:
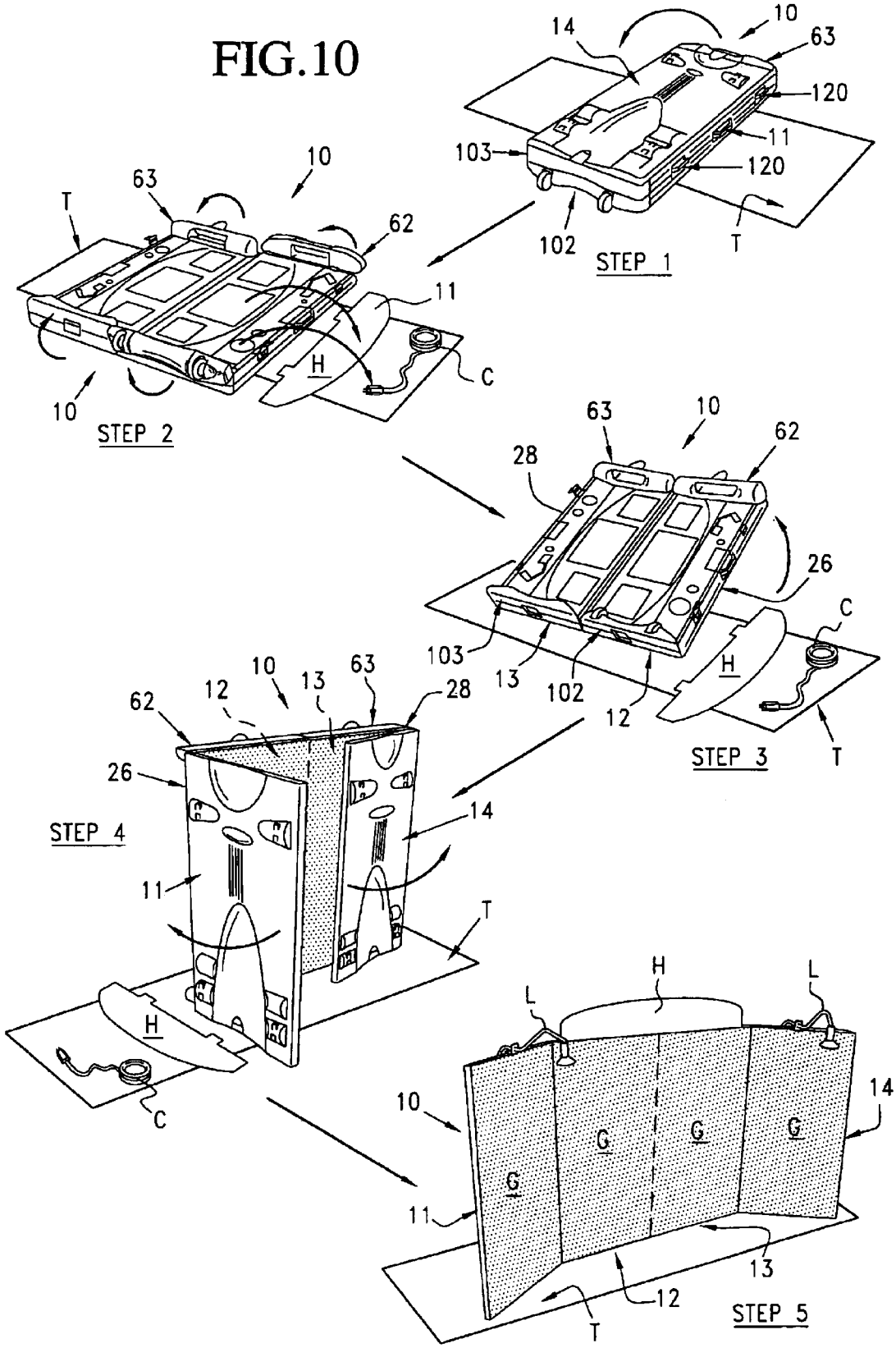
FIG. 10 is a diagrammatic view of the portable display case, and illustrates the systematic and consecutive steps for opening the display case, removing stored contents, and setting-up the portable display case to its final open display position.

The panels 11 through 14 include rear or "nondisplay" surfaces 25', 35', 45' and 55', respectively (FIG. 2), in the closed position (FIG. 1) of the portable display case 10. The surfaces 35', 45' of the respective panel members 12, 13 are in contiguous face-to-face opposing relationship, as will be apparent hereinafter, upon the folding of the panel members 12, 13 about the pivot means 27 through approximately 180° from the position illustrated in FIG. 2. The panel members 11, 14 are pivoted about the respective pivot means 26, 28 to bring the "display" surfaces 25, 35 and the "display" surfaces 45, 55, respectively, into face-to-face contiguous relationship in the closed position of the panel members 11 through 14, as is best illustrated in FIGS. 1 and 10 of the drawings. Since the surfaces 25', 55' of the respective panels 11, 14 define a substantial portion of the exterior configuration and style of the portable display case 10, they are appropriately aesthetically contoured and reinforced.

Figure 5:
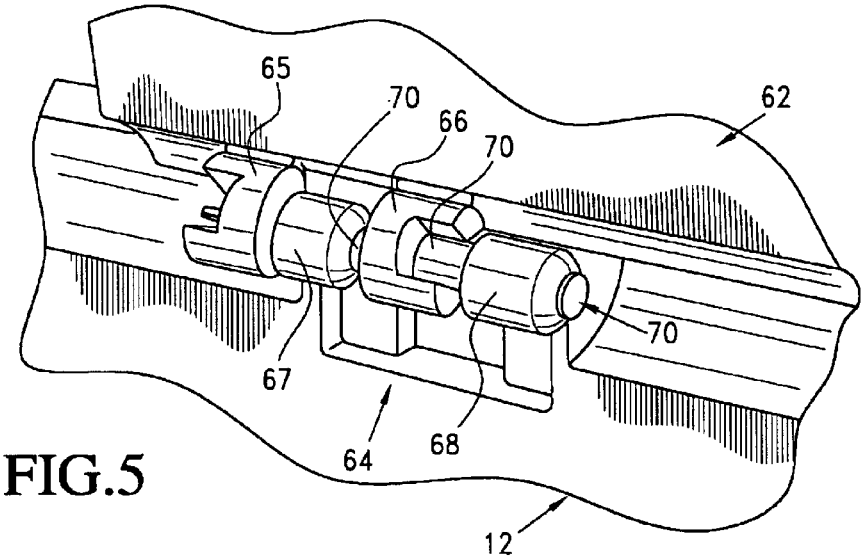
FIG. 5 is an enlarged fragmentary perspective view of the encircled portions of FIG. 2, and illustrates details of one of several identical pivots for connecting the handle members and the base members respective upper and lower edges of the central panel members.

In addition to the panel members 11 through 14, the portable display case 10 includes two handle members 62, 63 pivotally connected to the respective panel members 12, 13 by identical pivot means 64, 64 (FIGS. 2, 4 and 5), each defining a pivot axis (unnumbered) which is substantially normal to the pivot axes of the pivot means 26, 27 and 28. As is best illustrated in FIG. 5, each of the pivot means 64 includes two tubular journals 65, 66 which are compression molded in a conventional manner upon the blow-molding of the handle members 62, 63 and two tubular journals 67, 68 compression molded upon the blow molding of the panel members 12, 13. Each of the tubular journals 67 is positioned in a gap (unnumbered) between the tubular journals 65, 66, and each of the tubular journals 66 is positioned in a gap (unnumbered) between the tubular journals 67, 68. A pin 70 passes through and is retained in openings (unnumbered) of each of the tubular journals 65 through 68 thereby pivotally connecting through the pivot means 64 each of the handle members 62, 63 to the respective panel members 12, 13 for pivotal movement through an arc of substantially 180° from an overlying aligned position relative to the panel members 62, 63, respectively (FIGS. 1 and 2), to an offset position (FIGS. 3 and 7) at which the handle members 62, 63 are substantially normal to the respective panel members 12, 13. In the aligned position (FIGS. 1 and 2) of the handle members 62, 63, respective rear surfaces 35", 45" (FIG. 2) of the handle members 62, 63 lie substantially in the planes of the respective surfaces 35', 45' of the respective panel members 12, 13. When the handle members 62, 63 are rotated 180° about the pivot means 64 from the position shown in FIG. 2 to the positions shown in FIGS. 3, 4 and 7, respective lower surfaces 31', 41' (FIGS. 4 and 7) face upwardly. In the aligned position of the handle members 62, 63 of FIGS. 1 and 2, the surfaces 31', 41' of the handle members 62, 63 are in opposing contiguous face-to-face or surface-to-surface relationship with the upper edges 31, 41 of the respective panel members 12, 13.

Figure 7:
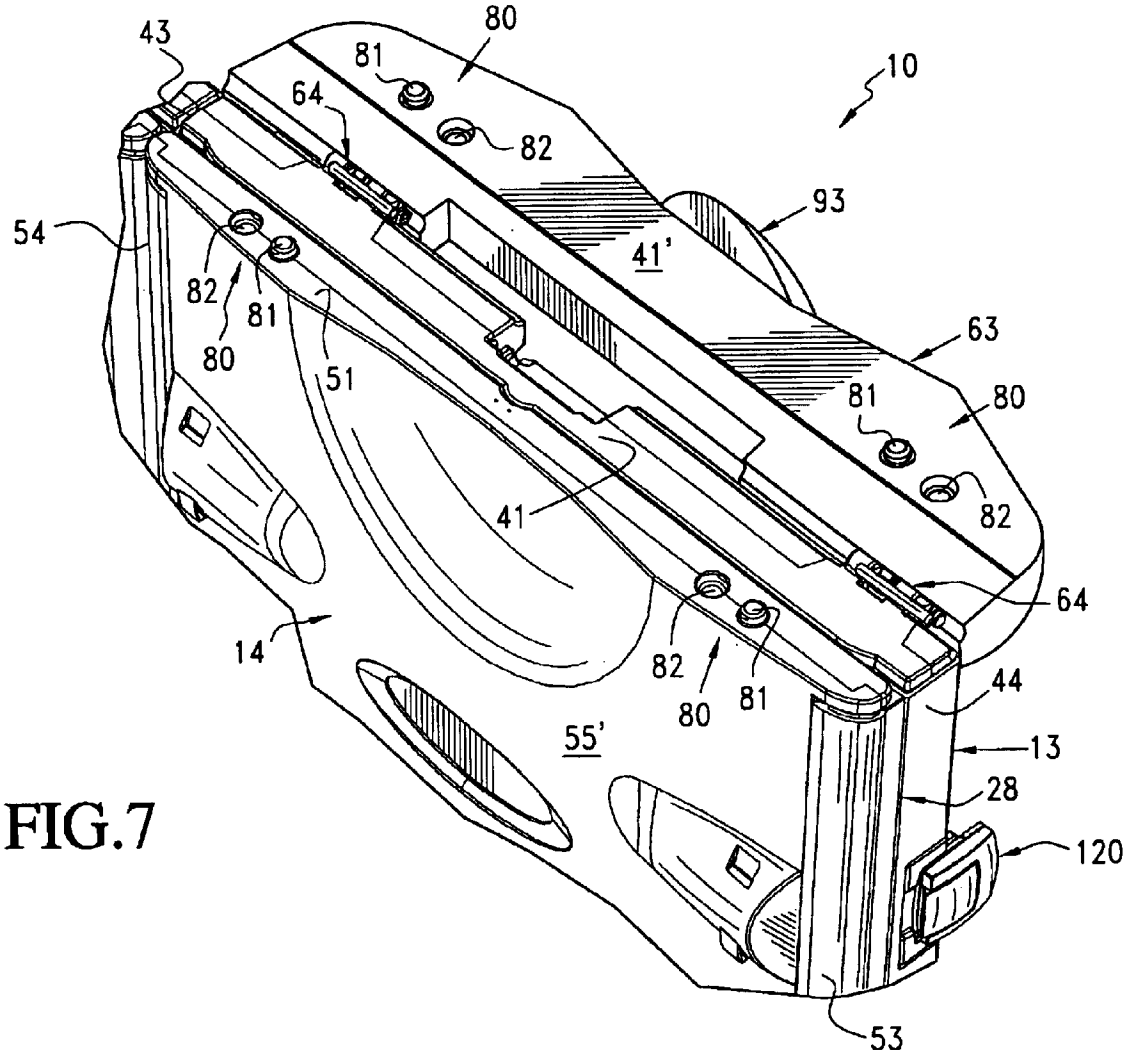
FIG. 7 is an enlarged fragmentary top perspective view of upper edge portions of two of the four panel members and one of the two handle members, and illustrates pairs of registerable projections and recesses thereof.

The handle members 62, 63 include at each of opposite ends thereof registration or aligning means 80 each in the form of an upwardly directed projection 81 and an adjacent mirror-imaged recess 82 (FIGS. 4 and 7). The upper edge 21 (FIG. 4) of the panel member 11 and the upper edge 51 of the panel member 14 also include identical aligning means 80 in the form of projections 81 and mirror-imaged recesses 82 which perform two functions, one of which is apparent from the description thus far, namely, upon the pivotal movement of the panel members 11, 14 about the pivot means 26 from the position illustrated in FIG. 4 to the positions illustrated in FIGS. 1 and 7 with the respective surfaces 25, 35 and 45, 55 in face-to-face contiguous relationship, the means 80, 80 of the panel member 11 are brought to a position at which they will register and be engaged by the means 80 of the handle member 62 when the handle member 62 is pivoted from the position shown in FIGS. 4 and 7 to the position shown in FIGS. 1 and 2. Likewise, when the panel member 14 is pivoted about the pivot means 28 from the position shown in FIG. 4 to bring the surfaces 45, 55 into contiguous face-to-face relationship, the means 80, 80 of the panel 14 will register with the means 80, 80 of the handle member 63 when the handle member 63 is pivoted from the position shown in FIG. 3 to the position shown in FIG. 2. In the latter positions, the panel members 11, 14 cannot be pivoted about the respective pivot means 26, 27 until the respective handle members 62, 63 have been pivoted from the aligned positions of FIGS. 1 and 2 to the positions shown in FIGS. 3 and 4.

Each of the handle members 62, 63 also includes respective recess means 85, 86 (FIGS. 2 and 7) in the form of an elongated opening spanned by a respective hand grip portion 86, 87. In the closed position of the portable display case 10 (FIG. 1) the surfaces 35", 45" of the respective handle members 62, 63 are in opposing face-to-face contiguous relationship which aligns the openings 85, 86 and the hand grip portions 87, 88 thereby forming a single hand-receiving opening 85, 86 and a hand grip or handle 86, 87 which can be utilized for pulling the portable display case 10 along a supporting surface in a manner to be described more fully hereinafter.

The handle members 62, 63 also include respective latching means or restraining means 92, 93 (FIGS. 1 and 4), respectively, in the form of tongues which project beyond the respective surfaces 31', 41' and engage the exterior surfaces 25', 55' of the respective panel members 11, 14 in the closed position of the portable display case (FIG. 1). The tongues 92, 93 further restrain or prevent the panel members 11, 14 from pivoting about their respective pivot means 26, 28 from the closed position thereof in contiguous substantially parallel relationship to the respective panel members 12, 13 until such time as the respective handle members 62, 63 have been pivoted from the positions illustrated in FIGS. 1 and 2 to the positions illustrated in FIGS. 3, 4 and 7.

Figure 6:
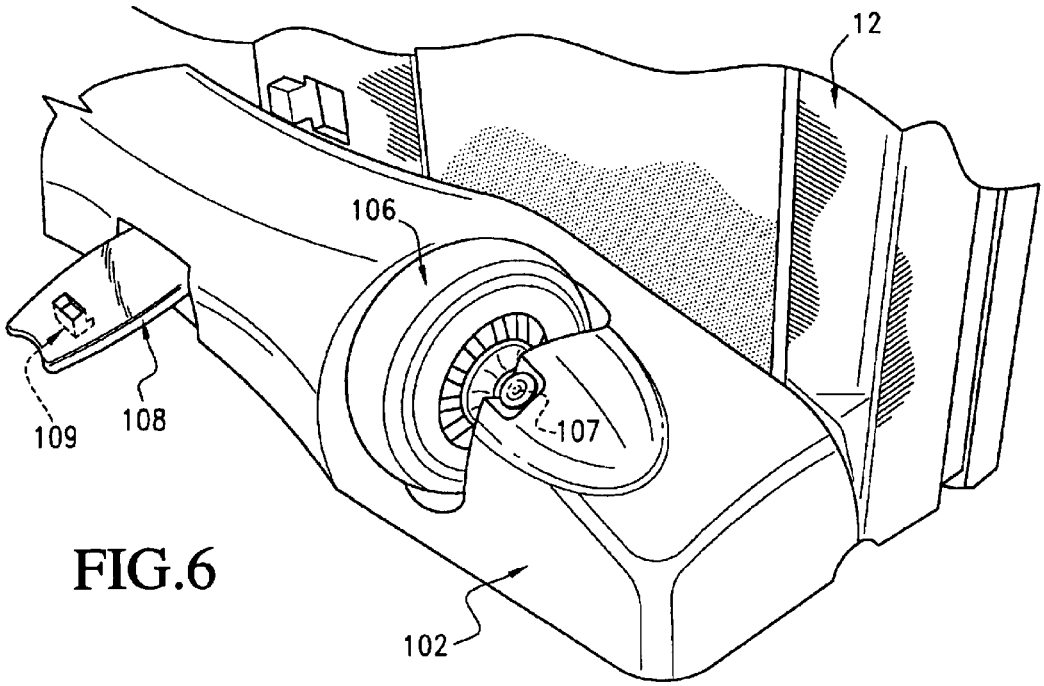
FIG. 6 is a fragmentary enlarged perspective view of the right-hand base member of FIG. 3, and illustrates details of a pivotal latching member and one of two rotatable wheels carried thereby.

The portable display case 10 also includes base members, rollable members or wheelable base members 102, 103 (FIGS. 1–3 and 6) which are pivotally connected by the pivot means 64 heretofore described to the respective lower edges 32, 42, respectively, of the respective panel members 12, 13. The base members 102, 103 include respective surfaces 35'", 45'" (FIG. 2) which substantially lie in the plane of the surfaces 35', 45' of the respective panel members 12, 13 in a first position thereof in which an upper surface 104, 105 of the respective base members 102, 103 is in contiguous abutting face-to-face relationship with the respective surfaces 32, 42 of the panel members 12, 13. When the panel members 12, 13 are pivoted about the pivot means 27 from the position illustrated in FIG. 2 to the closed position thereof (FIG. 1), the surfaces 35'" and 45'" of the respective base members 102, 103 are likewise in substantially contiguous abutting face-to-face relationship. The pivot means 64 effects the pivoting movement of the base members 102, 103 through an arc of substantially 18020 between the positions illustrated in FIGS. 1 and 2 and the positions illustrated in FIGS. 3 and 7 in which the surfaces 35'" and 45'" of the respective base members 102, 103 contact a supporting surface (unnumbered) in the form of feet or supports to add stability to the portable display case 10 in its display or upright position (FIGS. 3, 4 and 6).

The base member 102 (FIGS. 3 and 6) preferably includes wheel means 106 in the form of one or more identical wheels or rollers 106 each identically pivotally secured for rotation about an axle or a pin 107 which defines an axis of rotation substantially normal to the axes of the pivot means 26 through 28. As is most readily apparent from FIG. 1, in the closed position of the portable display case 10, the handle 87, 88 can be griped by a person to pull the portable display case 10 as the wheels 106 roll along an associated support surface.

Each of the base members 102, 103 includes a substantially centrally located latching mechanism 108 in the form of a latching tab 108 (FIGS. 1, 3 and 6) which is conventionally pivotally connected by a pivot pin (not shown) to each of the base members 102, 103 for pivoting movement about an axis parallel to the axes of the pivot means 64. Each latching member 108 includes an inwardly directed latching tongue 109 (FIG. 6) which latches to a latching ledge 110 (FIGS. 2 and 3) adjacent the lower edges 22, 52 of the respective panel members 11, 14 when the latter are in the closed positions thereof (FIG. 1) to thereby prevent the panel members 11, 14 from moving from their closed positions (FIG. 1) to the eventually open or display position thereof (FIGS. 2 through 4).

As is best illustrated in FIG. 1 of the drawings, in the closed transport position of the portable display case 10, the edges 33, 44 of the respective panel members 12, 13 which are remote and parallel to the pivot means 27 in the open position (FIG. 2) are secured in adjacent relationship to each other in the closed position (FIG. 1) by a pair of identical conventional latching means 120, typical of which might be found on a travel case, suitcase, attache case or the like.

A retractable handle 25 (FIGS. 1 and 3) corresponds to the handle of U.S. Pat. No. 6,189,592 B1, but is preferably spring-biased (not shown) to its housed position (FIG. 3) in a recess 126 of the panel member 12. In lieu of transporting the portable display case 10 by grasping the handle 87, 88, the handle 125 can be gripped to carry the portable display case 10 when closed, as opposed to wheeling the same along a supporting surface.

The surfaces 35', 45' of the respective panel members 12, 13 (FIG. 3) are provided with a number of recesses (unnumbered) for housing such elements as a header H, a lamp socket and cord L, an electrical extension cord C and halogen bulbs B. Three rectangular compartments (unnumbered) are each covered by an appropriate cover C1–C3 for housing therein small accessories utilized incident to setting-up the portable display case 10 to its in-use or display configuration (FIG. 4). The latter is accomplished in a manner evident from FIG. 10 of the drawings to which reference is now made.

In FIG. 10, the closed portable display case 10 is laid upon a supporting surface, such as a table T, with the panel member 11 lowermost (Step 1) after which the latching mechanisms 120 (FIG. 1) are unlatched and the panel members 11, 12 and 13, 14 are pivoted each as a unit about the pivot means 27 (Step 2).

Step 2 also involves removing all necessary accessories from the recesses of the panel members 12, 13, such as the header H, the lamp L and cord C, etc., followed by the unlatching of each of the latching means 108 by disengaging each tongue 109 from its associated latching ledge 110. The base members 102, 103 can now be pivoted from the closed positions in substantially coplanar aligned relationship to the panel members 11, 12 and 13, 14, respectively, to the offset position thereof (FIGS. 3, 4 and 7), followed by the handle members 62, 63 being similarly pivoted to the position shown best in FIGS. 3, 6 and Step 3 of FIG. 10.

Step 3 involves merely lifting the unlatched partially open portable display case 10 to a vertical position which brings the base members 102, 103 into supporting relationship to the table T (FIG. 3) after which the panel members 11, 14 can be pivoted about the respective pivot means 26, 28 (Step 4) toward the open or display position (Step 5) after which the lamp L, the header H and graphics G can be appropriately secured thereto (Step 5).

Figure 8:
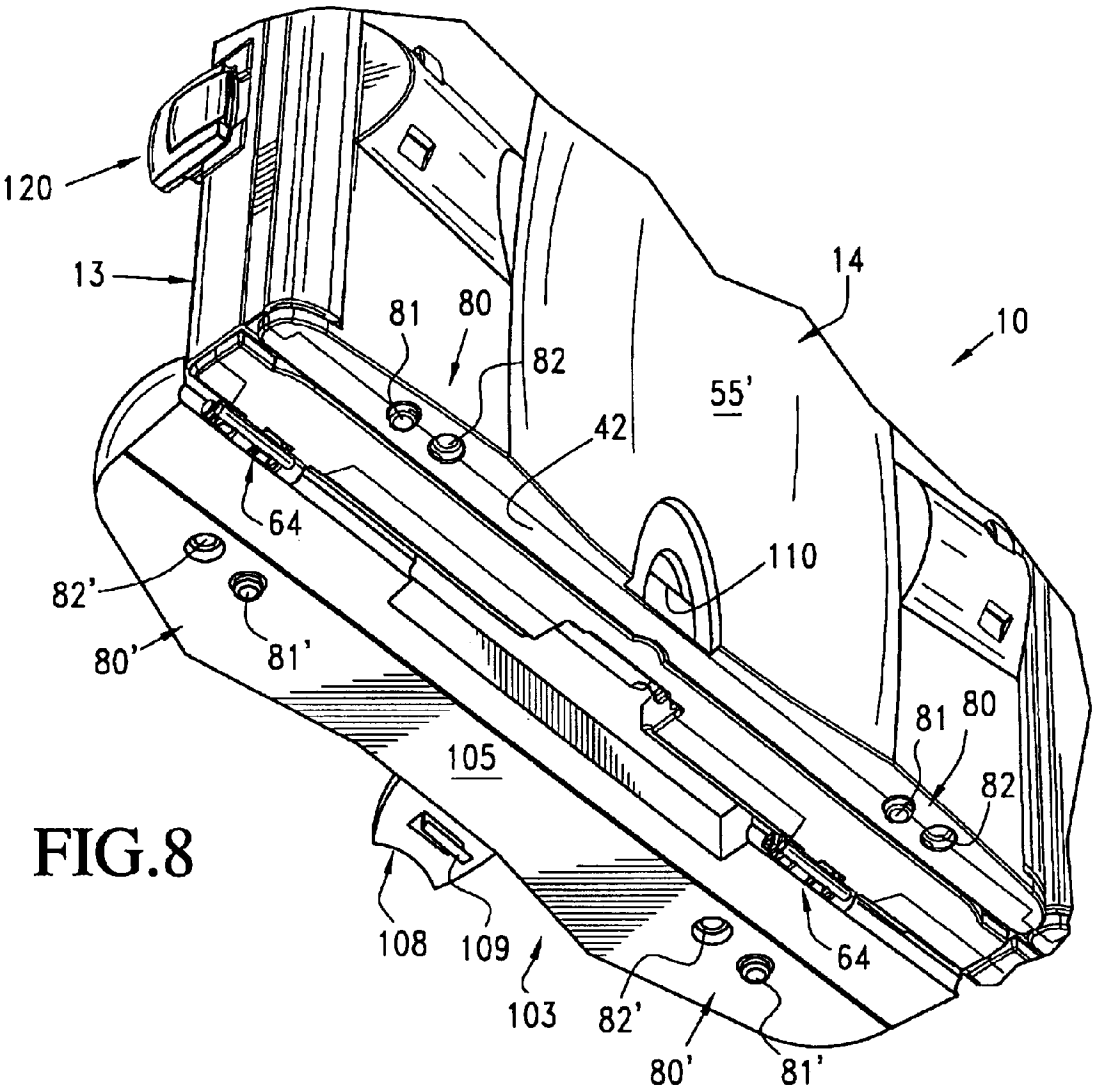
FIG. 8 is an enlarged fragmentary perspective view similar to FIG. 7, and illustrates like pairs of registerable projections and recesses carried by lower edge portions of an outer one of the panel members and one of the two base members.
Figure 9:
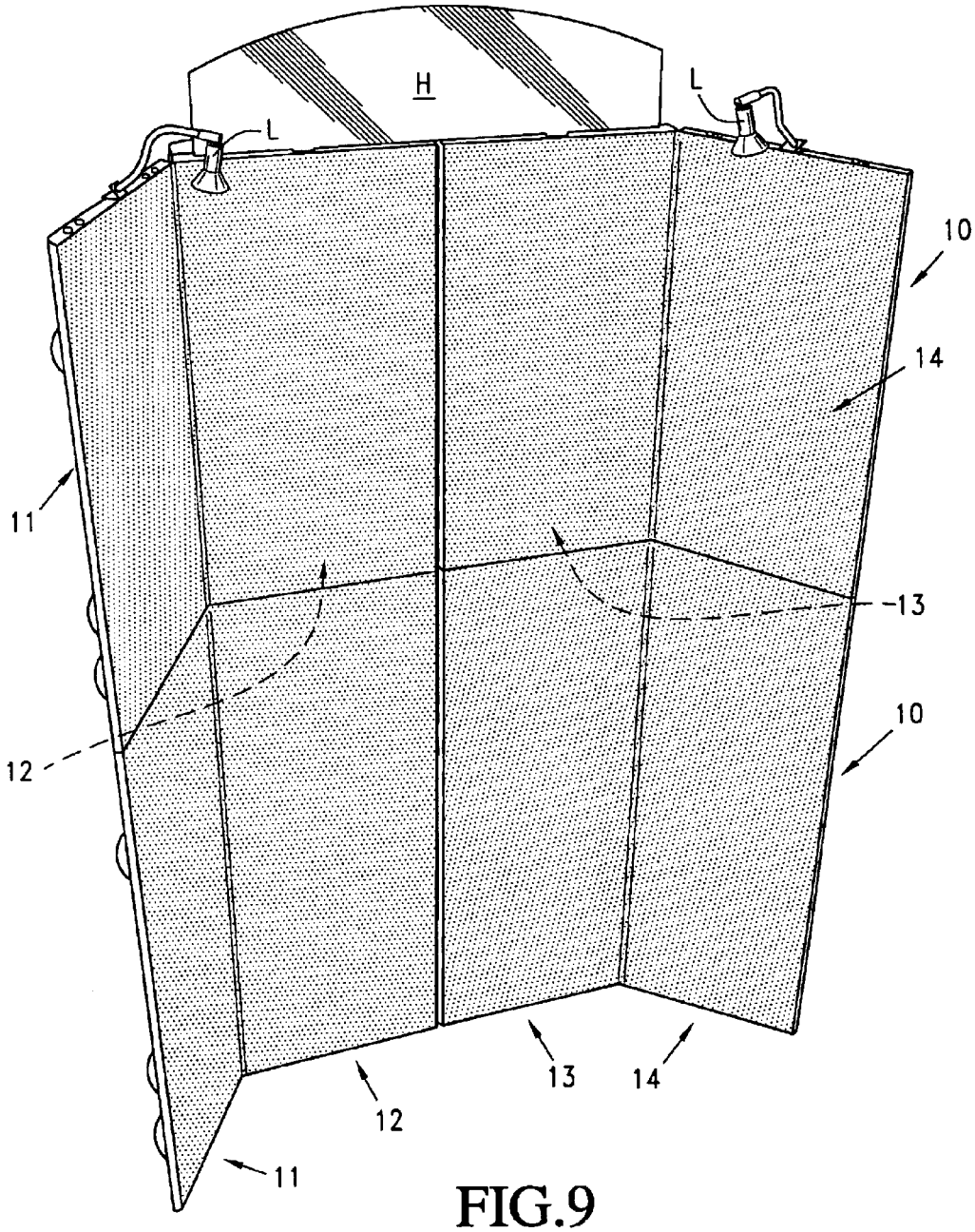
FIG. 9 is a fragmentary perspective view, and illustrates the manner in which two identical portable display cases of the invention are stacked one upon the other with the projections and recesses in registration.

Reference is made to FIG. 8 of the drawings in which the bottom edge portions 22, 52 of the respective panel members 11, 14 are shown having means 80' corresponding to the means 80 of the handle members 62, 63 in the form of projections 81' and recesses 82'. Though the projections 81' and recesses 82' are mirror images of each other and of the projections 81 and 82, the relative positions thereof are reversed. In other words, a vertical axis (not shown) passing through each of the projections 81, as is best visualized in FIG. 4, adjacent the upper edges 21, 31, 41 and 51 of the respective panel members 11 through 14 would pass through corresponding recesses 82' adjacent the respective lower edges 22, 32, 42 and 52 of the respective panels 11, 12, 13 and 14. Likewise, a vertical axis through each of the recesses 82 at the upper edge portions 21, 31, 41 and 51 of the panel members 11, 12, 13 and 14 passes axially through projections 81' adjacent the respective lower edges 22, 32, 42 and 52 of the respective panel members 11, 12, 13 and 14. The latter relationship is evident from a comparison of FIGS. 8 and 9, and by virtue of the same, any portable display 10 can be stacked upon an identically constructed portable display 10 at which time the projections 81 and the recesses 82 will register with the respective recesses 82' and projections 81' to achieve edge-to-edge upright stability when two such portable displays 10, 10 are stacked (FIG. 10). As is most evident from FIGS. 3, 4, 7 and 10, the tongues 92, 93 which project upwardly in FIG. 4 also bear against the exterior surfaces 35', 45' of the upper portable display 10 stacked vertically upon the lower portable display 10, thereby adding further stability to the stacked displays.

Although a preferred embodiment of the invention has been specifically illustrated and described herein, it is to be understood that minor variations may be made in the apparatus without departing from the spirit and scope of the invention, as defined by the appended claims.

What is claimed is:

1. A portable display case comprising at least two panel members, means for pivoting said two panel members relative to each other about a first pivot axis between a first position in which said panel members are in substantially closed opposing face-to-face relationship and a second position in which said panel members are in substantially open relationship, said panel members each having an upper edge portion, a handle member at the upper edge portion of a first of said two panel members, and means for pivoting said handle member to said first panel member upper edge portion for relative pivoting movement about a second pivot axis which is substantially normal to said first pivot axis between respective first and second substantially aligned and offset positions of said handle member relative to said first panel member.

2. The portable display case as defined in claim 1 wherein said handle member pivots through an arc of substantially 180° during pivotal movement thereof between said handle member first and second positions.

3. The portable display case as defined in claim 1 wherein said panel members upper edge portions each include an upper surface, said handle member includes a lower surface, and said handle member lower surface and said first panel member upper surface are in substantially contiguous opposing surface-to-surface relationship in said handle member first position.

4. The portable display case as defined in claim 1 including means for aligning said handle member relative to said second panel member in said panel members first position to thereby retain said two panel members in closed opposing face-to-face relationship.

5. The portable display case as defined in claim 4 wherein said aligning means include a projection of one of said handle member and said first panel upper edge portion in registered engagement with a recess of another of said handle member and said first panel upper edge portion.

6. The portable display case as defined in claim 4 wherein said aligning means include a projection and a recess of said handle member in registered engagement with a respective recess and projection of said first panel member upper edge portion.

7. The portable display case as defined in claim 4 wherein said aligning means include two pairs of a projection and a recess of said handle member in registered engagement with two pairs of a respective recess and projection of said first panel member upper edge portion.

8. The portable display case as defined in claim 3 wherein said handle member includes a tongue projecting beyond said handle member lower surface, and in said panel members first position said tongue is in contiguous overlying relationship to an outer surface of said second panel member thereby preventing relative movement of said panel members beyond said first aligned position.

9. The portable display case as defined in claim 1 wherein said panel member upper edge portion and said handle member lower surface each include means for registering with lower edge portions of two additional panel members stacked upon said two panel members in the second position thereof.

10. The portable display case as defined in claim 2 wherein said panel members upper edge portions each include an upper surface, said handle member includes a lower surface, and said handle member lower surface and said first panel member upper surface are in substantially contiguous opposing surface-to-surface relationship in said handle member first position.

11. The portable display case as defined in claim 2 including means for aligning said handle member relative to said second panel member in said panel members first position to thereby retain said two panel members in closed opposing face-to-face relationship.

12. The portable display case as defined in claim 3 including means for aligning said handle member relative to said second panel member in said panel members first position to thereby retain said two panel members in closed opposing face-to-face relationship.

13. The portable display case as defined in claim 5 wherein said handle member pivots through an arc of substantially 180° during pivotal movement thereof between said handle member first and second positions.

14. The portable display case as defined in claim 5 wherein said panel members upper edge portions each include an upper surface, said handle member includes a lower surface, and said handle member lower surface and said first panel member upper surface are in substantially contiguous opposing surface-to-surface relationship in said handle member first position.

15. A portable display case comprising at least two panel members, means for pivoting said two panel members relative to each other about a first pivot axis between a first position in which said panel members are in substantially closed opposing face-to-face relationship and a second position in which said panel members are in substantially open relationship, said panel members each having a lower edge portion, a wheelable member at the lower edge of a first of said two panel members, and means for pivoting said wheelable member relative to said first panel member lower edge portion for relative pivoting movement about a second pivot axis which is substantially normal to said first pivot axis between respective first and second substantially aligned and offset positions of said wheelable member and said first panel member.

16. The portable display case as defined in claim 15 wherein said wheelable member pivots through an arc of substantially 180° during pivotal movement thereof between said wheelable member first and second positions.

17. The portable display case as defined in claim 15 wherein said panel members lower edge portions each include a lower surface, said wheelable member includes an upper surface, and said wheelable member upper surface and said first panel member lower surface are in substantially contiguous opposing surface-to-surface relationship in said wheelable member first aligned position.

18. The portable display case as defined in claim 15 including means for securing said wheelable member to said second panel member in said panel members first position to thereby retain said two panel members in closed opposing face-to-face relationship.

19. The portable display case as defined in claim 15 including wheel means carried by said wheelable member for wheeling the portable display case.

20. The portable display case as defined in claim 15 including wheel means carried by said wheelable member for wheeling the portable display case when said panel members are in the closed position.

21. The portable display case as defined in claim 15 including wheel means carried by said wheelable member for wheeling the portable display case, said wheel means includes at least one wheel, and means for mounting said at least one wheel to said wheelable member for rotation about an axis substantially parallel to said second pivot axis.

22. The portable display case as defined in claim 18 including aligning means in the form of a projection of one of said wheelable member and said first panel lower edge portion in registered engagement with a recess of another of said wheelable member and said first panel lower edge portion.

23. The portable display case as defined in claim 18 including aligning means in the form of a projection and a recess of said handle member in registered engagement with a respective recess and projection of said first panel lower edge portion.

24. The portable display case as defined in claim 18 including aligning means in the form of two pairs of a projection and a recess of said wheelable member in registered engagement with two pairs of a respective recess and projection.

25. The portable display case as defined in claim 15 wherein said wheelable member and a second of said panel members include respective first and second cooperative latching means for cooperatively latching together when said two panel members are in said first position.

26. The portable display case as defined in claim 17 wherein said wheelable member and a second of said panel members include respective first and second cooperative latching means for cooperatively latching together when said two panel members are in said first position.

27. The portable display case as defined in claim 15 wherein said second panel lower edge portion and said wheelable member upper surface each include means for registering with upper edge portions of two additional panel members stacked upon said two panel members in the second position thereof.

28. The portable display case as defined in claim 16 wherein said panel members lower edge portions each include a lower surface, said wheelable member includes an upper surface, and said wheelable member upper surface and s aid first panel member lower surface are in substantially contiguous opposing surface-to-surface relationship in said wheelable member first position.

29. The portable display case as defined in claim 16 including means for securing said wheelable member to said second panel member in said panel members first position to thereby retain said two panel members in closed opposing face-to-face relationship.

30. The portable display case as defined in claim 16 including wheel means carried by said wheelable member for wheeling the portable display case.

31. The portable display case as defined in claim 16 including wheel means carried by said wheelable member for wheeling the portable display case when said panel members are in the closed position.

32. The portable display case as defined in claim 16 including wheel means carried by said wheelable member for wheeling the portable display case, said wheel means includes at least one wheel, and means for mounting said at least one wheel to said wheelable member for rotation about an axis substantially parallel to said second pivot axis.

33. The portable display case as defined in claim 16 including aligning means in the form of a projection of one of said wheelable member and said first panel lower edge portion in registered engagement with a recess of another of said wheelable member and said first panel lower edge portion.

34. The portable display case as defined in claim 28 including means for securing said wheelable member to said second panel member in said panel members first position to thereby retain said two panel members in closed opposing face-to-face relationship.

35. The portable display case as defined in claim 28 including wheel means carried by said wheelable member for wheeling the portable display case, said wheel means includes at least one wheel, and means for mounting said at least one wheel to said wheelable member for rotation about an axis substantially parallel to said second pivot axis.

36. The portable display case as defined in claim 28 including aligning means in the form of a projection and a recess of said handle member in registered engagement with a respective recess and projection of said first panel lower edge portion.

37. The portable display case as defined in claim 28 wherein said wheelable member and a second of said panel members include respective first and second cooperative latching means for cooperatively latching together when said two panel members are in said first position.

38. A portable display case comprising at least two panel members, first pivot means for pivoting said two panel members relative to each other about a first pivot axis between a first position in which said panel members are in substantially closed opposing face-to-face relationship and a second position in which said panel members are in substantially open relationship, said panel members each having an upper edge portion and a lower edge portion, a handle member at the upper edge portion of one of said two panel members, a wheelable member at the lower edge portion of one of said two panel members, second pivot means for pivoting said handle member to its associated panel member upper edge portion for relative pivoting movement about a second pivot axis which is substantially normal to said first pivot axis between respective first and second substantially aligned and offset positions of said handle member relative to its associated panel member, and third pivot means for pivoting said wheelable member to its associated panel member upper edge portion for relative pivoting movement about a third pivot axis which is substantially normal to said first pivot axis between respective first and second substantially aligned and offset positions of said wheelable member relative to its associated panel member.

39. The portable display case as defined in claim 38 wherein said one of said two panel members is the same panel member.

40. The portable display case as defined in claim 38 wherein said one of said two panel members is a different individual one of said panel members.

41. The portable display case as defined in claim 38 wherein said handle member pivots through an arc of substantially 180° during pivotal movement thereof between said handle member first and second positions.

42. The portable display case as defined in claim 38 wherein said wheelable member pivots through an arc of substantially 180° during pivotal movement thereof between said wheelable member first and second positions.

43. The portable display case as defined in claim 38 wherein said panel members upper edge portions each include an upper surface, said handle member includes a lower surface, and said handle member lower surface and said first panel member upper surface are in substantially contiguous opposing surface-to-surface relationship in said handle member first position.

44. The portable display case as defined in claim 38 wherein said panel members lower edge portions each include a lower surface, said wheelable member includes an upper surface, and said wheelable member upper surface and said first panel member lower surface are in substantially contiguous opposing surface-to-surface relationship in said wheelable member first position.

45. The portable display case as defined in claim 38 including means for aligning said handle member relative to said second panel member in said panel members first position to thereby retain said two panel members in closed opposing face-to-face relationship.

46. The portable display case as defined in claim 38 including means for securing said wheelable member to said second panel member in said panel members first position to thereby retain said two panel members in closed opposing face-to-face relationship.

47. The portable display case as defined in claim 41 wherein said panel members upper edge portions each include an upper surface, said handle member includes a lower surface, and said handle member lower surface and said first panel member upper surface are in substantially contiguous opposing surface-to-surface relationship in said handle member first position.

48. The portable display case as defined in claim 47 wherein said panel members lower edge portions each include a lower surface, said wheelable member includes an upper surface, and said wheelable member upper surface and said first panel member lower surface are in substantially contiguous opposing surface-to-surface relationship in said wheelable member first position.

49. A portable display case comprising at least two panel members, first pivot means for pivoting said two panel members relative to each other about a first pivot axis between a first position in which said panel members are in substantially closed opposing face-to-face relationship and a second position in which said panel members are in substantially open relationship, said panel members each having an upper edge portion and a lower edge portion, a handle member at the upper edge portion of each of said two panel members, second pivot means for pivoting a first of said handle members to an upper edge portion of a first of said two panel members, third pivot means for pivoting a second of said handle members to an upper edge portion of a second of said two panel members, and said second and third pivot means defining respective second and third pivot axes which are each substantially normal to said first pivot axis to effect pivoting movement of said handle members between respective first and second substantially aligned and offset positions relative to the respective first and second panel members.

50. The portable display case as defined in claim 49 wherein said handle members each pivot through an arc of substantially 180° during pivotal movement thereof between said handle members first and second positions.

51. The portable display case as defined in claim 49 wherein said panel members upper edge portions each include an upper surface, said handle members each include a lower surface, and said handle members lower surfaces and said panel members upper surfaces are in substantially contiguous opposing surface-to-surface relationship in said handle members first position.

52. The portable display case as defined in claim 49 wherein each of said handle members includes a hand grip portion.

53. The portable display case as defined in claim 49 wherein each of said handle members includes a hand opening spanned by a handgrip portion.

54. The portable display case as defined in claim 49 wherein each of said handle members includes a hand grip portion, and said hand grip portions are contiguous each other in the first position of said panel members whereby the hand grip portions can be simultaneously gripped by a person's hand.

55. The portable display case as defined in claim 49 wherein each of said handle members includes a hand opening spanned by a handgrip portion, and said hand grip portions and hand openings are contiguous each other in the first position of said panel members whereby the hand grip portions and openings can be simultaneously respectively gripped and spanned by a person's hand.

56. The portable display case as defined in claim 50 wherein said panel members upper edge portions each include an upper surface, said handle members each include a lower surface, and said handle members lower surfaces and said panel members upper surfaces are in substantially contiguous opposing surface-to-surface relationship in said handle members first position.

57. The portable display case as defined in claim 50 wherein each of said handle members includes a hand grip portion.

58. The portable display case as defined in claim 51 wherein each of said handle members includes a hand grip portion.

59. The portable display case as defined in claim 56 wherein each of said handle members includes a hand grip portion.

60. The portable display case as defined in claim 56 wherein each of said handle members includes a hand opening spanned by a hand grip portion.

61. The portable display case as defined in claim 56 wherein each of said handle members includes a hand grip portion, and said hand grip portions are contiguous each other in the first position of said panel members whereby the hand grip portions can be simultaneously gripped by a person's hand.

62. The portable display case as defined in claim 56 wherein each of said handle members includes a hand opening spanned by a handgrip portion, and said hand grip portions and hand openings are contiguous each other in the first position of said panel members whereby the hand grip portions and openings can be simultaneously respectively gripped and spanned by a person's hand.

63. A portable display case comprising at least two panel members, first pivot means for pivoting said two panel members relative to each other about a first pivot axis between a first position in which said panel members are in substantially closed opposing face-to-face relationship and a second position in which said panel members are in substantially open relationship, said panel members each having an upper edge portion and a lower edge portion, a base member at the lower edge portion of each of said two panel members, second pivot means for pivoting a first of said base members to a lower edge portion of a first of said two panel members, third pivot means for pivoting a second of said base members to a lower edge portion of a second of said two panel members, said second and third pivot means defining respective second and third pivot axes which are each substantially normal to said first pivot axis to effect pivoting movement of said base members between respective first and second substantially aligned and offset positions relative to the respective first and second panel members, and said base members in said first offset positions support said panel members in substantially upright relationship in said panel members second open position.

64. The portable display case as defined in claim 63 wherein said base members each pivot through an arc of substantially 180° during pivotal movement thereof between said base members first and second positions.

65. The portable display case as defined in claim 63 wherein said panel members lower edge portions each include a lower surface, said base members each include an upper surface, and said base members upper surfaces and said panel members lower surfaces are in substantially contiguous opposing surface-to-surface relationship in said base members first position.

66. The portable display case as defined in claim 63 wherein one of said base members includes means for wheeling the portable display case.

67. The portable display case as defined in claim 63 wherein one of said base members includes means for wheeling the portable display case when said panel members are in the closed first position thereof.

68. The portable display case as defined in claim 65 wherein one of said base members includes means for wheeling the portable display case, and means for securing said wheelable base member to a third panel member in said panel members first position to thereby retain said one and third panel members in closed opposing face-to-face relationship.

69. The portable display case as defined in claim 63 wherein one of said base members includes means for wheeling the portable display case when said panel members are in the closed position thereof.

70. The portable display case as defined in claim 63 wherein one of said base members includes means for wheeling the portable display case, said wheeling means including at least one wheel, and means for mounting said at least one wheel to said wheelable base member for rotation about an axis substantially normal to said first pivot axis.

71. The portable display case as defined in claim 65 wherein only one of said base members includes means for wheeling the portable display case.

72. The portable display case as defined in claim 65 including a third panel member, fourth pivot means for pivoting said third panel members to one of said first and second panel members about a fourth pivot axis substantially parallel to said first and second pivot axes, one of said base members of said first and second panel members includes aligning means in the form of a projection and a recess in registered engagement with one of a recess and a projection respectively of a lower surface of said third panel in said first closed position.

73. The portable display case as defined in claim 64 wherein said panel members lower edge portions each include a lower surface, said base members each include an upper surface, and said base members upper surfaces and said panel members lower surfaces are in substantially contiguous opposing surface-to-surface relationship in said base members first position.

74. The portable display case as defined in claim 64 wherein one of said base members includes means for wheeling the portable display case.

75. The portable display case as defined in claim 64 wherein one of said base members includes means for wheeling the portable display case when said panel members are in the closed first position thereof.

76. The portable display case as defined in claim 64 wherein one of said base members includes means for wheeling the portable display case, and means for securing said wheelable base member to a third panel member in said panel members first position to thereby retain said one and third panel members in closed opposing face-to-face relationship.

77. The portable display case as defined in claim 64 wherein one of said base members includes means for wheeling the portable display case when said panel members are in the closed position thereof.

78. The portable display case as defined in claim 65 wherein one of said base members includes means for wheeling the portable display case.

79. The portable display case as defined in claim 65 wherein one of said base members includes means for wheeling the portable display case when said panel members are in the closed position thereof.

80. The portable display case as defined in claim 79 wherein one of said base members includes means for wheeling the portable display case.

81. The portable display case as defined in claim 79 wherein one of said base members includes means for wheeling the portable display case when said panel members are in the closed first position thereof.

82. A portable display case comprising at least two panel members, first pivot means for pivoting said two panel members relative to each other about a first pivot axis between a first position in which said panel members are in substantially closed opposing face-to-face relationship and a second position in which said panel members are in substantially open relationship, said panel members each having an upper edge portion and a lower edge portion, a handle member at the upper edge portion of a first of said two panel members, a base member at the lower edge portion of said first panel member, second pivot means for pivoting said handle member to said first panel member panel member upper edge portion for relative pivoting movement about a second pivot axis which is substantially normal to said first pivot axis between respective first and second substantially aligned and offset positions, third pivot means for pivoting said base member to said first panel member lower edge portion for relative pivoting movement about a third pivot axis which is substantially normal to said first pivot axis between respective first and second substantially aligned and offset positions, means for latching one of said handle member and said base member to said first panel member in said panel members closed position, and means carried by the other of said handle member and base member for overlyingly abutting an exterior surface of said second panel member in said panel members closed position to prevent opening thereof toward said panel members open position.

83. The portable display case as defined in claim 82 wherein said latching means includes a pivotable latching tab.

84. The portable display case as defined in claim 82 wherein said latching means includes a pivotable latching tab carried by said base member.

85. The portable display case as defined in claim 82 wherein said latching means includes a pivotable latching tab carried by said base member for pivoting about a pivot axis in substantially normal relationship to said first pivot axis.

86. The portable display case as defined in claim 82 wherein said overlyingly abutting means is a tongue projecting toward said latching means.

87. The portable display case as defined in claim 82 wherein said latching means is carried by said base member.

88. The portable display case as defined in claim 82 wherein said overlyingly abutting means is carried by said handle member.

89. The portable display case as defined in claim 82 wherein said latching means is carried by said base member, and said overlyingly abutting means is carried by said handle member.

90. The portable display case as defined in claim 85 wherein said overlyingly abutting means is a tongue projecting toward said latching means.

91. The portable display case as defined in claim 90 wherein said latching means is carried by said base member, and said overlyingly abutting means is carried by said handle member.

92. A portable display case comprising first, second, third and fourth panel members each having upper, lower, first side and second side edges; first, second and third pivot means for pivotally connecting said first and second, second and third, and third and fourth panel member respectively for pivoting about respective first, second and third pivot axes disposed in substantially parallel relationship to each other between a first closed position in which said second and third panel members are sandwiched between said first and fourth panel member and a second open position in which said panel member are in substantially upright face-to-face relationship, first and second base members, fourth and fifth pivot means for pivotally connecting said first and second base members for pivoting movement about fourth and fifth pivot axes respectively for movement between substantially aligned and offset positions relative to the respective second and third panel members, first and second handle members, and sixth and seventh pivot means for pivotally connecting said first and second handle members for pivoting movement about sixth and seventh pivot axes respectively for movement between substantially aligned and offset positions relative to the respective second and third panel members.

93. The portable display case as defined in claim 92 wherein said handle members each pivot through an arc of substantially 180° during pivoting movement thereof between said handle member first and second position.

94. The portable display case as defined in claim 92 wherein said base members each pivot through an arc of substantially 180° during pivoting movement thereof between said handle member first and second positions.

95. The portable display case as defined in claim 92 wherein said handle members and said first and fourth panel members upper edges have projections seated in recesses in the aligned positions of said handle members, and said base members and said first and fourth panel members lower edges have projections seated in recesses in the aligned positions of said base members.

96. The portable display case as defined in claim 92 wherein said handle members and said first and fourth panel members upper edges have projections seated in recesses in the aligned positions of said handle members, said base members and said first and fourth panel members lower edges having projections seated in recesses in the aligned positions of said base members, and said hand members projections and recesses mirror image said base members projections and recesses whereby identically constructed portable display cases can be stacked in handle member-to-base member projection-to-recess registered relationship.

97. The portable display case as defined in claim 92 wherein each handle member includes a tongue projecting toward said lower edges in overlapping relationship to an exterior surface of an associated one of said first and fourth panel members.

98. The portable display case as defined in claim 92 wherein each base member includes latching means for latching an associated one of said first and fourth panel members.

99. The portable display case as defined in claim 92 wherein at least one of said base members includes wheel means for wheeling the portable display case.

100. The portable display case as defined in claim 92 wherein at least one of said base members includes wheel means for wheeling the portable display case when said panel members are in the closed position thereof.

101. The portable display case as defined in claim 92 wherein each handle member includes a tongue projecting toward said lower edges in overlapping relationship to an exterior surface of an associated one of said first and fourth panel members, said wheel means includes at least one wheel, and means for mounting said at least one wheel to said at least one base member for rotation about an axis substantially parallel to said fourth and fifth axes.

102. The portable display case as defined in claim 92 wherein said first and second handle members each include a hand grip portion.

103. The portable display case as defined in claim 92 wherein said first and second handle members each include a hand opening spanned by a hand grip portion.

104. The portable display case as defined in claim 92 wherein said first and second handle members each include a hand grip portion, and said hand grip portions are contiguous each other in the aligned positions of said handle members when said panel members are in the closed position thereof whereby the hand grip portions can be simultaneously gripped by a person's hand.

105. The portable display case as defined in claim 92 wherein said first and second handle members each include a hand opening spanned by a hand grip portion, and said hand grip portions and hand openings are contiguous each other in the aligned positions of said handle members when said panel members are in the closed position thereof whereby the hand grip portions and openings can be simultaneously respectively gripped and spanned by a person's hand.

106. The portable display case as defined in claim 92 including first and second cooperative latching means disposed adjacent said first and third pivot means for latching said second and third panel members together in said panel members closed position.

107. The portable display case as defined in claim 93 wherein said base members each pivot through an arc of substantially 180° during pivoting movement thereof between said handle member first and second positions.

108. The portable display case as defined in claim 107 wherein said handle members and said first and fourth panel members upper edges have projections seated in recesses in the aligned positions of said handle members, and said base members and said first and fourth panel members lower edges having projections seated in recesses in the aligned positions of said base members.

109. The portable display case as defined in claim 107 wherein said handle members and said first and fourth panel members upper edges have projections seated in recesses in the aligned positions of said handle members, said base members and said first and fourth panel members lower edges having projections seated in recesses in the aligned positions of said base members, and said handle members projections and recesses mirror image said base members projections and recesses whereby identically constructed portable display cases can be stacked in handle member-to-base member projection-to-recess registered relationship.

110. The portable display case as defined in claim 107 wherein each handle member includes a tongue projecting toward said lower edges in overlapping relationship to an exterior surface of an associated one of said first and fourth panel members.

111. The portable display case as defined in claim 107 wherein each base member includes latching means for latching an associated one of said first and fourth panel members.

112. The portable display case as defined in claim 107 wherein at least one of said base members includes wheel means for wheeling the portable display case.

113. The portable display case as defined in claim 107 wherein at least one of said base members includes wheel means for wheeling the portable display case wherein said panel members are in the closed position thereof.

114. The portable display case as defined in claim 107 wherein each handle member includes a tongue projecting toward said lower edges in overlapping relationship to an exterior surface of an associated one of said first and fourth panel members, said wheel means includes at least one wheel, and means for mounting said at least one wheel to said at least one base member for rotation about an axis substantially parallel to said fourth and fifth axes.

115. The portable display case as defined in claim 107 wherein said first and second handle members each include a hand grip portion.

116. The portable display case as defined in claim 107 wherein said first and second handle members each include a hand opening spanned by a hand grip portion.

117. The portable display case as defined in claim 107 wherein said first and second handle members each include a hand grip portion, and said hand grip portions are contiguous each other in the aligned positions thereof when said panel members are in the closed position thereof whereby the hand grip portions can be simultaneously gripped by a person's hand.

118. The portable display case as defined in claim 107 wherein said first and second handle members each include a hand opening spanned by a hand grip portion, and said hand grip portions and hand openings are contiguous each other in the aligned positions thereof when said panel members are in the closed position thereof whereby the hand grip portions and openings can be simultaneously respectively gripped and spanned by a person's hand.

* * * * *